US006725603B1

(12) United States Patent
Pansini

(10) Patent No.: US 6,725,603 B1
(45) Date of Patent: Apr. 27, 2004

(54) EMERGENCY EXIT REVOLVING DOOR

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 0 days.

(21) Appl. No.: 10/457,295

(22) Filed: Jun. 9, 2003

(51) Int. Cl.[7] ..... E05D 15/02
(52) U.S. Cl. ..... 49/42; 49/141; 109/70
(58) Field of Search ..... 49/42, 141; 109/8, 109/69, 70, 71, 73; 52/64

(56) References Cited

U.S. PATENT DOCUMENTS 4,255,900 A * 3/1981 Magnani ..... 49/141

* cited by examiner

*Primary Examiner*—Jerry Redman
(74) *Attorney, Agent, or Firm*—Howard Cohen

(57) ABSTRACT

An emergency exit revolving door apparatus includes a revolving door assembly that is generally comprised of a ceiling panel, a floor panel, and a pair of curved vertical panels extending therebetween to form a rigid, conjoint assembly. The revolving door assembly is disposed in a door opening of a building, and is mounted on a dolly that is disposed within a channel inset in the floor and extending outwardly from the exterior of the door opening. In an emergency situation, if a throng of people rush to the revolving door and push outwardly on it with sufficient force, the door assembly will be driven outwardly by the force. The dolly will translate along the channel so that the entire revolving door assembly translates outwardly from the door opening of the building and clear the door opening to enable a substantially unobstructed emergency exit path.

19 Claims, 4 Drawing Sheets

EMERGENCY EXIT REVOLVING DOOR

CROSS-REFERENCE TO RELATED APPLICATIONS

Not applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to revolving doors used in building and construction, as is well known in the prior art. In particular, it relates to an emergency safety release for a revolving door 2. Description of Related Art Revolving doors are well known in the prior art for providing ingress and egress to buildings. They have many advantages over standard swinging doors, including an airlock effect that minimizes loss of heated/cooled air from the building, inherent control of pedestrian flow through the doorway, and inherent security aspects. The major drawback of revolving doors is the potential for the door becoming blocked in an emergency situation where people rush to the door and push the door at both sides, thereby blocking its rotation and completely obstructing movement through the revolving door. Many lives have been lost in these panic conditions. In response, building codes typically have recognized this danger and now require that standard swinging doors be disposed adjacent to the revolving door to provide emergency ingress or egress. Unfortunately, the existence of these swinging doors in proximity to the revolving door diminishes all of the advantages of revolving doors noted above.

One approach to solving this problem in the prior art provides "breakaway" hinges for mounting the doors to their supporting revolving door shaft. In the panic situation described above, forceful pushing on the doors of the revolving unit cause the hinges to yield so that the doors pivot on the shaft mounts. The doors thereby move to open at least some space through the unit. However, the continued presence of the door shaft and the doors hung thereon acts to constrict the emergency opening and does not promote quick egress through the door.

BRIEF SUMMARY OF THE INVENTION

The present invention generally comprises an emergency exit revolving door apparatus that provides unobstructed passage in the event of an emergency escape situation.

The apparatus of the invention includes a revolving door assembly that is generally comprised of a ceiling panel, a floor panel, and a pair of curved vertical panels extending therebetween to form a rigid, conjoint assembly. A door shaft extends from the floor disk to ceiling disk and is spaced generally equidistantly between the curved vertical panels. A plurality of door panels are secured to the door shaft in planes that extend radially outwardly and are angularly spaced in a generally equiangular relationship. The number and size of the door panels and their angular spacing may conform to any of the standards known in the prior art and approved for building codes. The assembly is disposed in a door opening of a building, and is sealed therein to provide a revolving door closure very similar in function and appearance to those known in the prior art. However, the assembly is not structurally tied to the building, so that limited translational movement of the door assembly is permitted, as described below.

The door shaft extends upwardly from a movable support such as a dolly. The dolly is disposed within a channel that is inset in the floor or sidewalk and extending outwardly from the exterior of the door opening of the building. The dolly is provided with wheels or other means for permitting the dolly to translate along the channel. The open slot of the channel is covered by one or more frangible or flexible panels that may be colored or otherwise treated either to blend in with the surrounding floor or sidewalk surface, or to be visually prominent to prevent any step hazard. The dolly is also provided with a tooth-like lug protrusion extending upwardly therefrom and dimensioned to either remove, break, or otherwise clear the panels covering the open slot of the channel as the door assembly translates along the channel.

In normal operation the door assembly is sealed and removably secured in the door opening of the building. In an emergency situation, if a throng of people rush to the revolving door and push outwardly on it with sufficient force, the seal around the door opening will break away, and the door assembly will be driven outwardly by the force. The dolly will translate along the channel, as the slot cover is cleared by the protrusion, so that the entire revolving door assembly translates outwardly from the door opening of the building. The channel is sufficiently long to enable the entire revolving door assembly to translate sufficiently outwardly to clear the door opening and enable a substantially unobstructed emergency exit path.

The forces required to release the door seals and move the revolving door assembly along the channel are easily determined by mechanical engineering considerations, so that the door assembly may not be translated by everyday usage, nor by air pressure differences between the ambient pressure and the interior pressure of the building. Likewise, the revolving door assembly may be latched or anchored to the building whenever it is desired to close the door and secure it.

DETAILED DESCRIPTION OF THE INVENTION

The present invention generally comprises an emergency exit revolving door apparatus that provides unimpeded passage in the event of an emergency escape situation. (For the purposes of this patent, an emergency escape situation is described as an incident in which a group of people in a great hurry rush toward the revolving door apparatus. This circumstance may cause a prior art revolving door to jam as the onrushing people push on both sides of the door, thereby preventing any rotation and blocking the exit completely.)

Figure 1:
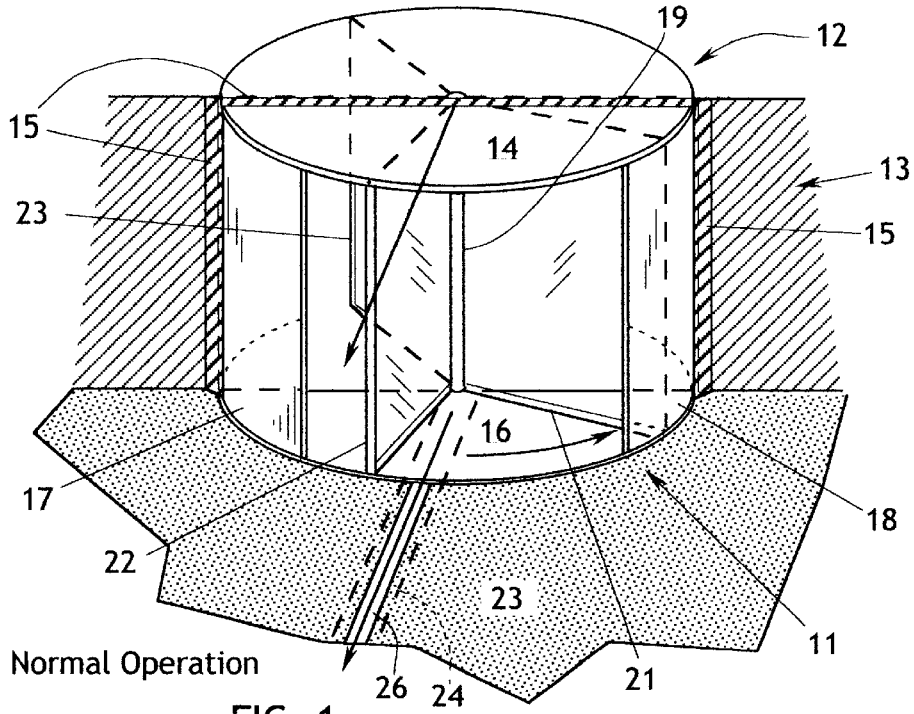
FIG. 1 is a perspective view of the emergency exit revolving door apparatus of the present invention in a typical building installation.

With reference to FIG. 1, the revolving door apparatus includes a revolving door assembly 11 that is installed in the door opening 12 of a building 13. The revolving door assembly 11 is comprised of a ceiling panel 14, a floor panel 16, and a pair of curved panels 17 and 18 extending vertically therebetween. The ceiling panel 14 may comprise a disk having a substantial portion of a circular periphery, and the floor panel 16 has approximately one-half of the periphery of a circle of the same radius. The curved panels described angular segments of a cylindrical surface centered on the circular periphery of the floor and ceiling panels. Sealing means 15 are applied to the junction of the revolving door assembly and the door opening 12 to form a weatherproof installation.

A door shaft 19 extends vertically between the radial centers of the floor and ceiling panels, and is supported for free rotation, as described below. A trio of rectangular door panels 21, 22, and 23 are each secured at an inner edge to the door shaft 19 and supported for rotation therewith. The panels are dimensioned to permit the outer edges of the panels 21–23 to slide in close proximity to the interior surfaces of the curved panels 17 and 18, and the upper and lower edges to slide in close proximity to the floor and ceiling panels, so that an effective moving seal is formed therewith. In this aspect the assembly 11 is similar to prior art revolving door assemblies. The number and size of the door panels and their angular spacing may conform to any of the standards known in the prior art and approved for building codes, and the door panels may be constructed of materials and components accepted for such uses.

Figure 3:
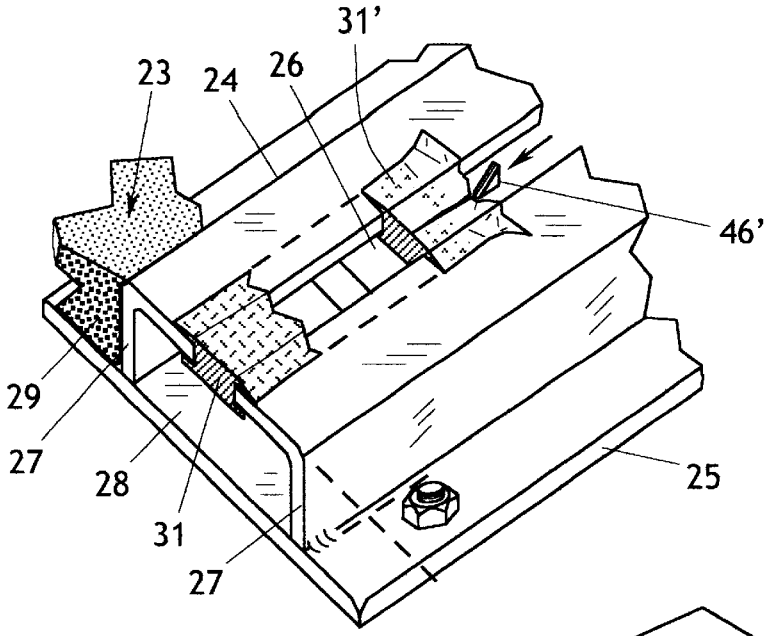
FIG. 3 is a perspective view of a portion of the channel portion of the emergency exit revolving door apparatus of the present invention.
Figure 5:
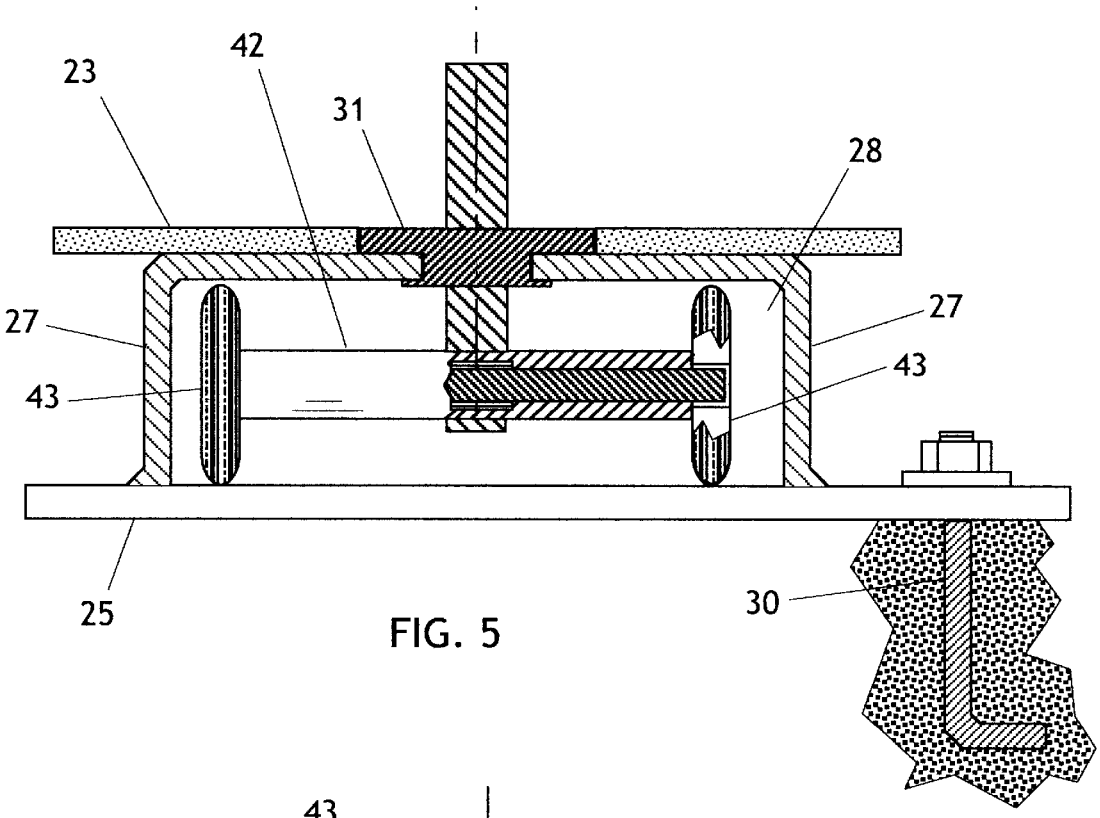
FIG. 5 is a cross-sectional elevation of the dolly assembly within the channel portion, taken transverse to the longitudinal axis of the channel.

With additional reference to FIG. 3, adjacent to the door opening 12 there is a track or channel 24 inset into the surface 23 of a floor or sidewalk 29 so that the slot opening 26 of the channel 24 is substantially flush with the surface 23. The channel 24 may be an extrusion known in the prior art, or may comprise a pair of flange units 27 disposed in parallel, confronting alignment and secured to a similarly aligned base plate 25. The base plate 25 is anchored in the supporting ground media or concrete by anchor bolts 30, as shown in FIG. 5. The confronting flange units 27 define a longitudinally extending cavity 28 and the upwardly opening slot 26. A slot cover 31 may be releasably secured in the slot 26. In the embodiment shown the slot cover comprises a longitudinally extending flexible component having the cross-sectional configuration of a flattened "I" shape to engage the opposed edges of the slot 26. The cover 31 is provided to protect the slot and cavity 28 from dirt and debris. The cover is engineered to be removable, as explained below.

Figure 4:
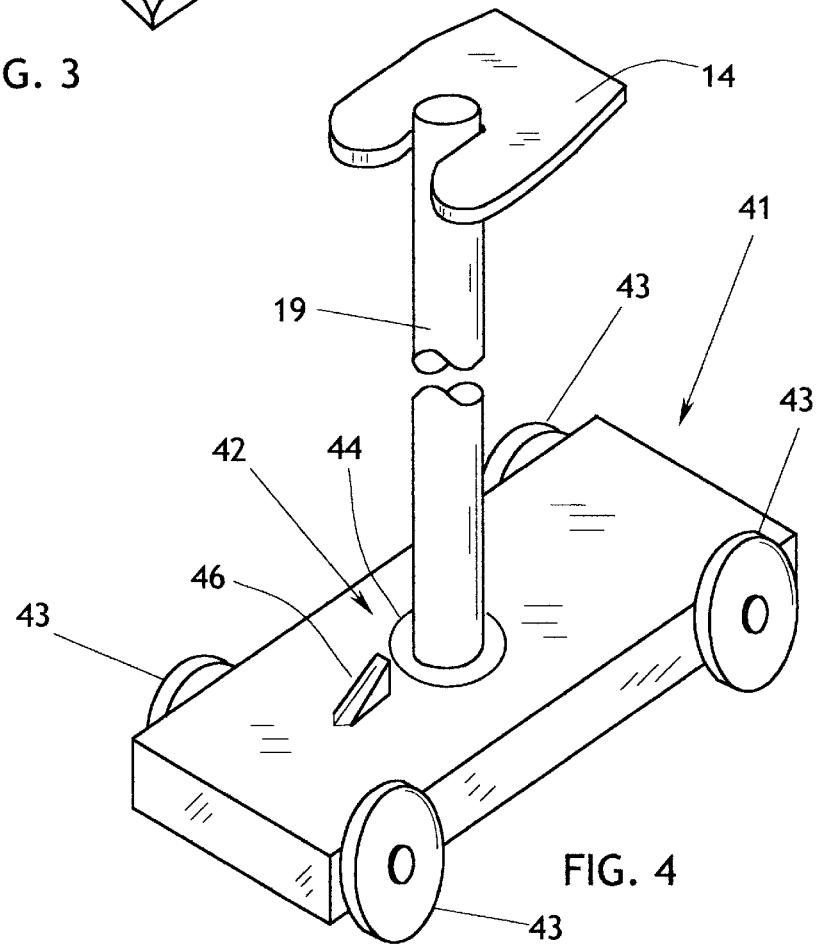
FIG. 4 is a perspective view of the dolly and revolving door shaft assembly of the invention.

The revolving door assembly 11 further includes a mobile support assembly 41, as shown in FIGS. 4 and 5. The assembly 41 includes a dolly 42 that is dimensioned to be received within cavity 28 of the channel 24 in freely translating fashion. The dolly is provided with a plurality of wheels 43 that are supported on the dolly 42 by bearings on wheel shafts. The dolly wheels are adapted to provide rolling translation along the cavity 28 of the channel 24. The dolly 42 also supports a bearing assembly 44 that receives the lower end of the revolving door shaft 19 to support the shaft and enable its free rotation about its vertical axis. The upper end of the door shaft 19 is supported at its upper end in the ceiling panel 14 of the revolving door assembly 11. The dolly 42 is further provided with a tooth-like lug or blade 46 extending upwardly therefrom and disposed to engage the cover 31 that is snap-engaged within the slot 26, as described below. Note that the cover 31 is depicted as being substantially flush with the floor surface 23, and that the flange arrangement of the cover 31 enables it to support substantial downward load while being able to unsnap upwardly under the urging of a much smaller upward force.

The mobile support assembly 41 is designed to bear at least some, if not most, of the weight of the revolving door assembly 11, so that the revolving door assembly is slidably movable along the slot 26 of the channel 24. The floor assembly 16 is arranged to be slidable outwardly over the surface 23 of the adjacent floor or sidewalk, by providing sufficient clearances, skid pads, or other means for slidable support. Note that the floor assembly 16 is formed as a half-circle that is disposed generally outwardly of the door opening 12, so that the weight of a throng of people rushing to exit through the revolving door cannot load down the floor assembly 16 within the building.

In normal operation of the invention, as shown in FIGS. 1 and 3, the revolving door assembly 11 is secured in the door opening 12 of the building 13, and the doors 21–23 revolve about door shaft 19 to allow individuals to enter and exit the building. The door shaft turns on bearing 44 in dolly 42, and the dolly 42 is disposed at the inner (building) end of the cavity 28 of channel 24. The revolving door assembly is generally sealed within the door opening to establish a weatherproof door closure.

Figure 2:
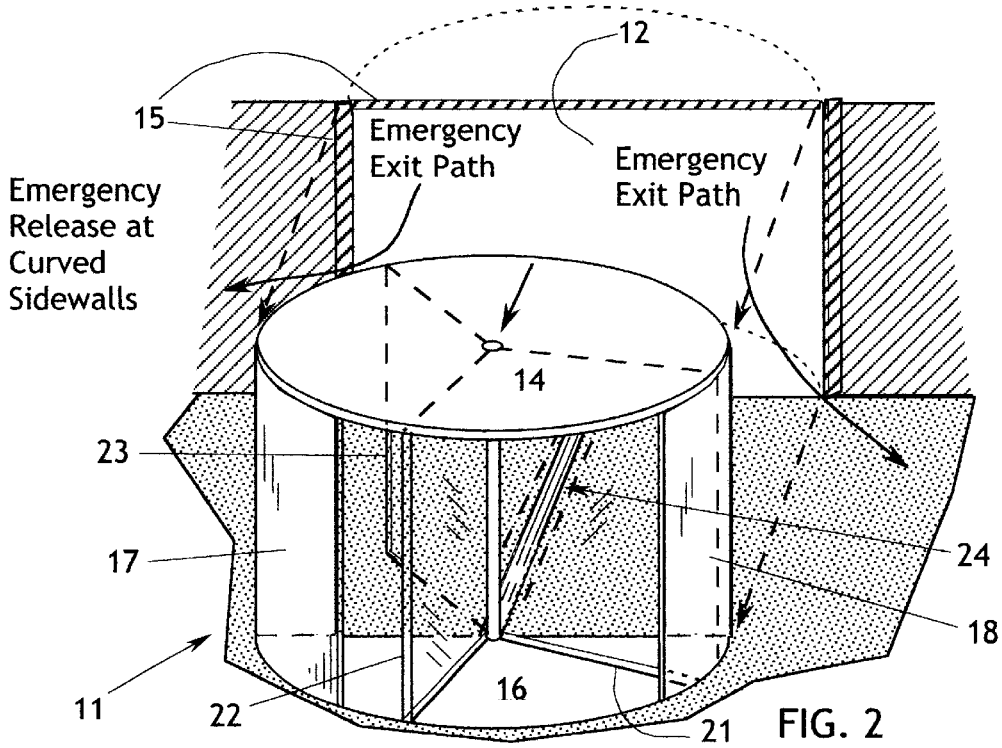
FIG. 2 is a perspective view as in FIG. 1, showing the position of the revolving door assembly after being displaced outwardly in an emergency release situation.

In the event of an emergency escape situation, the door may operate normally an allow a steady stream of persons to exit the door as it revolves. If, however, a crowd of people rush to the door in a panic and push on the door assembly to escape, the outward force of the throng is sufficient to urge the revolving door assembly 11, together with its mobile support assembly 41, to begin to translate outwardly along the channel 24. The sharp lug 46' (FIG. 3) impinges on the cover 31' as the dolly translates along the channel and either severs or bursts or unsnaps the cover panel 31' from the slot 26, so that the movement of the revolving door assembly is not impeded by the cover 31. The entire revolving door assembly 11 moves outwardly from the door opening 12, as shown in FIG. 2, so that door opening is completely unblocked and available as an emergency exit path. Thus the revolving door assembly is no impediment to the escape of people within the building.

Figure 6:
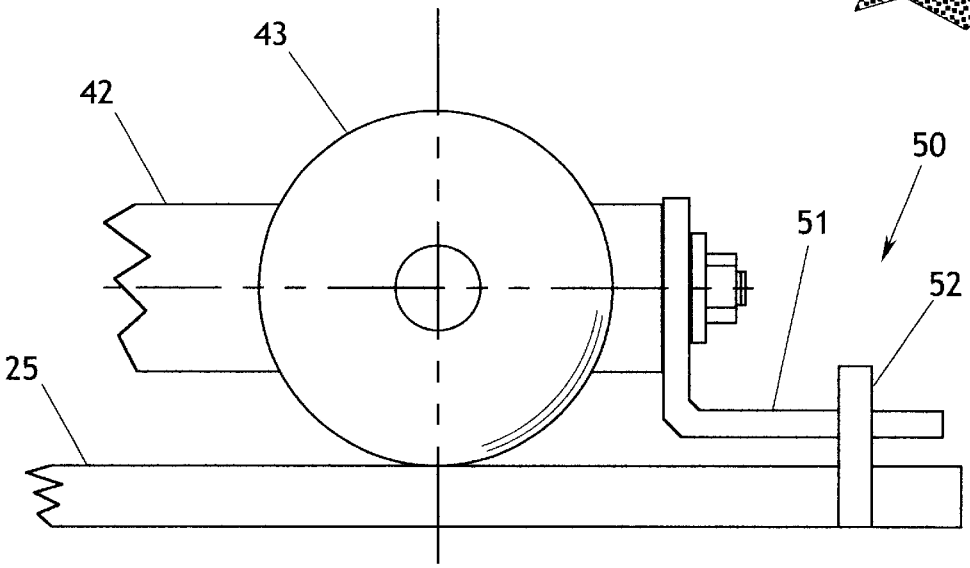
FIG. 6 is a fragmentary side elevation of the dolly assembly, showing one form of latch mechanism for the dolly assembly.
Figure 8:
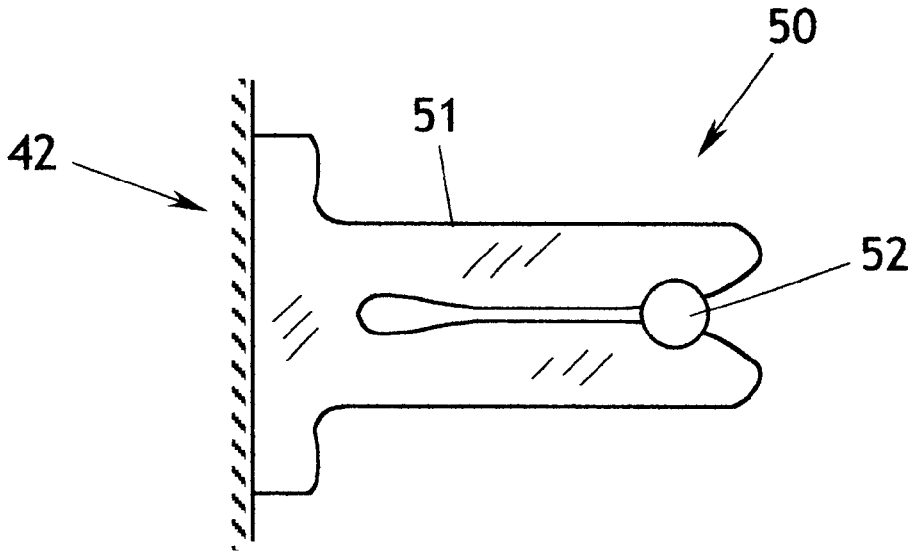
FIG. 8 is a plan view of another latch assembly for the dolly.

The breakaway force required to move the revolving door assembly along the channel 24 may be engineered by providing a release mechanism 50 having a known (designed) breakaway force threshold. With regard to FIGS. 6 and 8, the release mechanism 50 may include a bracket 51 extending longitudinally from a rear (inner) portion of the dolly 42. The bracket 51 may include a clevis end that snap engages a pin 52 anchored in the channel 24 or base plate 25. The snap disengagement of pin 52 requires a longitudinal thrust that exceeds a predetermined value, assuring that the revolving door assembly cannot be moved to its emergency release position by forces that are experienced in normal use, such as air pressure differences between the ambient outdoor air pressure and the interior air pressure of the building, or the force required to rotate the revolving door in ordinary use.

Figure 7:
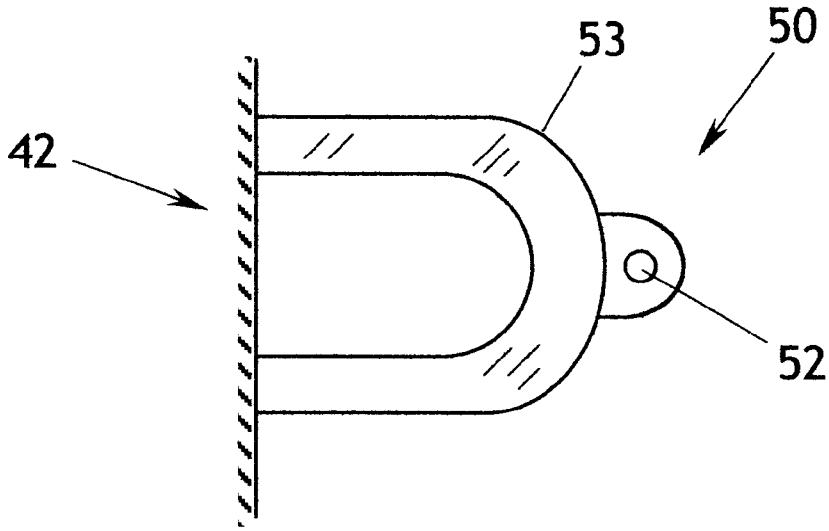
FIG. 7 is a plan view of a further latch assembly for the dolly.

With regard to FIG. 7, an alternative embodiment of the release mechanism 50 includes a horseshoe magnet 53 that is magnetically engaged with a ferromagnetic portion of the dolly 42. The pin 52 extends through the horseshoe magnet 53 to anchor it within the channel 24. The magnetic adhesion between the magnet 53 and the dolly 42 is engineered to be sufficient to prevent translation of the revolving door assembly by any ordinary forces experienced in everyday operation.

It may be noted that the revolving door assembly may be latched or anchored to the building whenever it is desired to close the door and secure it. Any form of sliding door latch or similar security apparatus known in the prior art may be employed to rigidly secure the revolving door assembly 11 in the door opening and prevent breaking and entering through the revolving door assembly.

It may be noted that the floor portion 16 acts as a cover for a portion of the slot 26 of the channel 24, and that the slot cover 31 may be utilized only for the slot portion extending from the outer periphery of the floor panel 16 to the outer extent of the channel 24. In that case, the cover-removing lug 46 may be secured to the periphery of the floor panel at its intersection with the slot 26. The operation of the components is otherwise substantially as described.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. An emergency exit revolving door apparatus, including:

a revolving door assembly dimensioned to be installed in a door opening, a mobile support assembly supporting said revolving door assembly, said mobile support assembly including means for translating said revolving door apparatus from said door opening in an outward direction, and translated out of said door opening.

2. The apparatus of claim 1, wherein said revolving door assembly includes a door shaft extending generally vertically, and a plurality of door panels extending in radial planes from said door shaft.

3. The apparatus of claim 2, wherein said mobile support assembly includes a dolly adapted to translate in said outward direction, and means for supporting a lower end of said door shaft for rotation about a generally vertical axis.

4. The apparatus of claim 3, wherein said revolving door assembly includes a floor portion, a ceiling portion, and said door shaft extending between said floor and ceiling portions.

5. The apparatus of claim 4, wherein said revolving door assembly further includes a pair of curved, vertically extending panels joined between said floor and ceiling portions in a conjoint assembly.

6. The apparatus of claim 5, wherein said door panels are dimensioned to have edges that move angularly in close proximity to said floor and ceiling portions, and outer edges that move in close proximity to inner surfaces of said curved, vertically extending panels.

7. The apparatus of claim 3, wherein said mobile support assembly further includes a track channel extending longitudinally from said door opening in said outward direction, said dolly being received in said channel and adapted for longitudinal translation therealong, said channel being inset in a floor surface adjacent to said door opening.

8. The apparatus of claim 7, wherein said channel includes a longitudinally extending, upwardly opening slot, said door shaft extending upwardly from said dolly through said slot to said revolving door assembly.

9. The apparatus of claim 8, further including a slot cover member releasably secured in said slot.

10. The apparatus of claim 9, further including means for removing said slot cover from said slot as said revolving door assembly translates longitudinally along said channel.

11. The apparatus of claim 10, wherein said means for removing includes a protrusion extending from said dolly into said slot.

12. The apparatus of claim 9, wherein said slot cover member is substantially flush with an adjacent floor surface.

13. The apparatus of claim 7, wherein said dolly includes a plurality of wheels for supporting said dolly and oriented to provide rolling translation along said channel in said outward direction.

14. The apparatus of claim 7, further including release mechanism means for establishing a minimum force required to push said revolving door assembly in said outward direction.

15. The apparatus of claim 14, wherein said release mechanism means includes a clevis bracket extending between said dolly and a fixed pin in said channel, said clevis bracket engaging said pin with a predetermined release force.

16. The apparatus of claim 14, wherein said release mechanism means includes a magnet extending between said dolly and a fixed point in said channel, said magnet having a magnetic adhesion that is overcome with a predetermined release force.

17. The apparatus of claim 1, further including means for sealing said revolving door assembly in said door opening.

18. The apparatus of claim 1, wherein said revolving door assembly includes a floor portion, a ceiling portion, and a door shaft extending between said floor and ceiling portions.

19. The apparatus of claim 18, wherein said revolving door assembly further includes a pair of curved, vertically extending panels joined between said floor and ceiling portions in a conjoint assembly, and means for supporting said conjoint assembly by said mobile support means.

* * * * *